US012208862B1

(12) United States Patent
Separovich

(10) Patent No.: US 12,208,862 B1
(45) Date of Patent: Jan. 28, 2025

(54) BILGE PUMP SUPPORT

(71) Applicant: Robert Anton Separovich, Anacortes, WA (US)

(72) Inventor: Robert Anton Separovich, Anacortes, WA (US)

( * ) Notice: Subject to any disclaimer, the term of this patent is extended or adjusted under 35 U.S.C. 154(b) by 423 days.

(21) Appl. No.: 17/701,579

(22) Filed: Mar. 22, 2022

Related U.S. Application Data

(60) Provisional application No. 63/165,540, filed on Mar. 24, 2021.

(51) Int. Cl.
*B63B 13/00* (2006.01)
*E04G 3/00* (2006.01)

(52) U.S. Cl.
CPC ..... *B63B 13/00* (2013.01); *E04G 3/00* (2013.01)

(58) Field of Classification Search
CPC ..... B63B 13/00; B63J 5/00; E04G 3/00
USPC ..... 114/183 R; 248/146, 284.1
See application file for complete search history.

(56) References Cited

U.S. PATENT DOCUMENTS

| | | | |
|---|---|---|---|
| 2,749,846 | A | 6/1956 | Felix |
| 3,684,406 | A | 8/1972 | Edwards |
| 3,743,447 | A | 7/1973 | Lynch |
| 4,073,455 | A | 2/1978 | Gunther |
| 5,211,363 | A | 5/1993 | Brown |
| 5,860,792 | A | 1/1999 | Marks |
| 6,276,908 | B1 | 8/2001 | Batchelder et al. |
| 6,322,030 | B1 | 11/2001 | Marra |
| 6,715,994 | B2 | 4/2004 | Patel et al. |
| 6,763,775 | B1 | 7/2004 | Sweeting |
| 8,714,501 | B2 | 5/2014 | Dang et al. |
| 9,598,146 | B2 | 3/2017 | Palmisano |

FOREIGN PATENT DOCUMENTS

KR 20150028572 A 3/2015

OTHER PUBLICATIONS

Ebay, E-Z Bilge Pump Bracket, retrieved from:https://www.ebay.com/i/264257413494?chn=ps&norover=1&mkevt=1&mkrid=711-117182-37290-0&mkcid=2&itemid=264257413494&targetid=935431405413&device=c&mktype=pla&googleloc=1025403&poi=&campaignid=10829254281&mkgroupid=106351005733&rlsatarget=pla-935431405413&abcld=9300396&merchantid=114786034&gclid=Cj0KCQiAqdP9BRDVARIsAGSZSAmKlbxmcubgC3bLttzXL7kvS-oiBJss0FtcwsoBJE0AcAbXDp0NWgaAtD_EALw_wcB, Nov. 18, 2020, 1 page.

*Primary Examiner* — Lars A Olson
(74) *Attorney, Agent, or Firm* — Puget Sound Patents; Dwayne E Rogge

(57) ABSTRACT

Disclosed herein are several examples of a bilge pump support comprising: a mounting plate configured to be attached to a vessel; the mounting plate having a first pivot on a first longitudinal end thereof, an extension plate having a first end connected to the first pivot and extending longitudinally therefrom in a first longitudinal direction; a second pivot on a second longitudinal end of the extension plate; a pump plate connected to the second pivot and extending longitudinally therefrom and extending longitudinally therefrom in the first longitudinal direction; the pump plate configured to have a bilge pump attached thereto within a bilge of a vessel; and wherein the pump plate is longitudinally and vertically offset from the mounting plate.

18 Claims, 3 Drawing Sheets

BILGE PUMP SUPPORT

RELATED APPLICATIONS

This application claims priority of U.S. Provisional Patent Application Ser. No. 63/165,540 filed on Mar. 24, 2021, incorporated herein by reference.

BACKGROUND OF THE DISCLOSURE

Field of the Disclosure

This disclosure relates to the field of mounting supports for fluid pumps mounted in a holding space, for example a bilge of a vessel.

BRIEF SUMMARY OF THE DISCLOSURE

In the field of submersible pumps and similar apparatus, it is often difficult to properly position the pump or device most effectively due to access issues. Disclosed herein are several examples of a bilge pump support to alleviate some or all of these issues. The pump support comprising: a mounting plate configured to be attached to a vessel; the mounting plate having a first pivot on a first longitudinal end thereof, an extension plate having a first end connected to the first pivot and extending longitudinally therefrom in a first longitudinal direction; a second pivot on a second longitudinal end of the extension plate; a pump plate connected to the second pivot and extending longitudinally therefrom and extending longitudinally therefrom in the first longitudinal direction; the pump plate configured to have a bilge pump attached thereto within a bilge of a vessel; and wherein the pump plate is longitudinally and vertically offset from the mounting plate.

The bilge pump support of one example has a negative buoyancy greater than a positive buoyancy of the bilge pump and attached components. In one example, the pump plate has a density greater than 1 gram per cubic centimeter (1 g/cm3) and/or the pump plate and bilge pump combined having a density greater than 1 gram per cubic centimeter (1 g/cm3) which is the density of water, thus the sub assembly will not float.

In one example, the bilge pump support is formed where the first pivot is unhindered. Thus, the extension plate and the pump plate move freely about the first pivot. In another example, the second pivot is unhindered such that the pump plate may freely move about the second pivot. In another example, both the first pivot and the second pivot are unhindered.

The bilge pump support may be arranged wherein the first pivot has a removable pivot pin or similar component configured to release the extension plate from the mounting plate for ease in removal of the bilge pump from the bilge.

The bilge pump support may be arranged where the extension plate has a longitudinally aligned wiring conduit.

DETAILED DESCRIPTION OF THE DISCLOSURE

In many fields of work there exists holding spaces where fluids are stored or where fluids flow. In many of these holding spaces it is necessary or desired to remove all or at least some of the fluids therefrom. Often a pump, strainer, filter, pipe fitting, hose fitting, etc. into the holding space where the water/fluid is retained.

In the field of submersible pumps, it is often difficult to install such pumps or structures into the holding space as the installation location (e.g., bilge of a vessel) is often below a water level. In this disclosure, the term pump may encompass pumps including water pumps, strainer, filter, pipe fitting, hose fitting, etc. which are placed in a holding space and part of a fluid removal system. In moving vessels, it is greatly desired to mount (affix) such pumps to the vessel to ensure that the pump does not tip over or move/reposition during operation or storage. Generally, these pumps work much better in an upright position, and when tipped over their efficiency declines. In addition, the position of the water inlet may no longer be in an optimal location for removal of water from the holding space. In addition, such pumps often vibrate during operation, and when combined with movement of the vessel and water in the holding space the pump may relocate to a position that is especially ineffective and difficult or impossible to remove from the holding space.

To alleviate these concerns and others, the bilge pump support 20 disclosed herein has one end which attaches so a vessel with an opposing end with a fluid pump attached thereto. The opposing end extends into the holding space.

Figure 5:
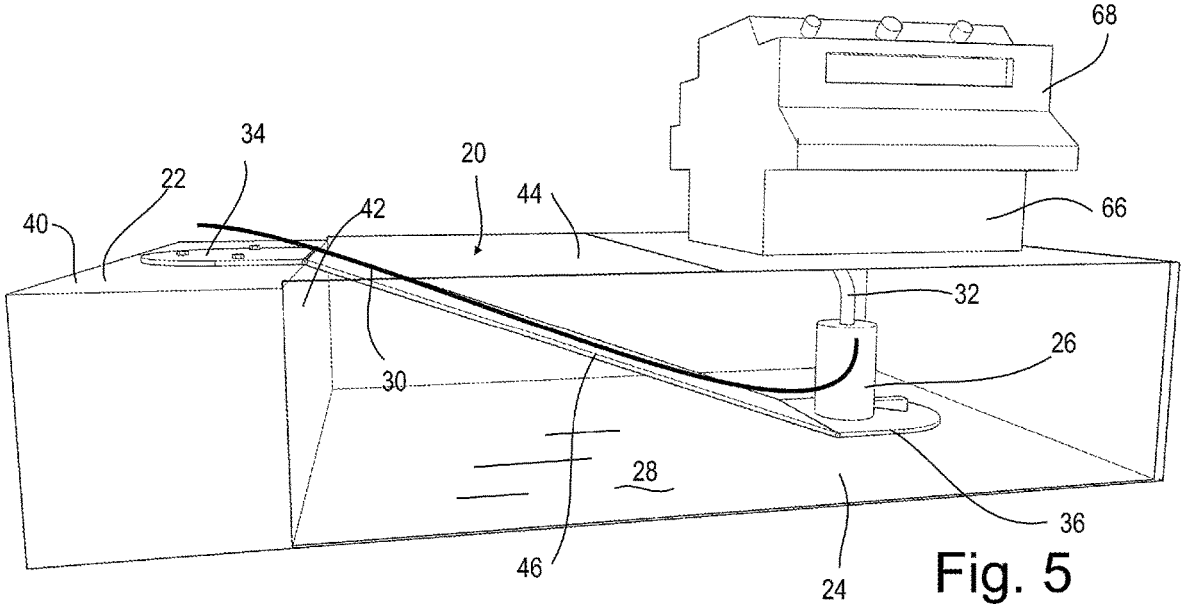
FIG. 5 is a partial view of the bilge pump support of FIG. 4 with one sidewall of the bilge shown transparent to reveal the components therein.

As shown in the example of FIG. 5, the bilge pump support 20 has a first end which is attached to the vessel 22 and a second end which extends into the holding space/bilge 24. A pump 26 is attached to the second end of the bilge pump support 20. This second end is then then placed into the bilge 24. In this position, a portion of the bilge pump support 20 may rest on the floor 28 of the bilge.

The power supply cords, data cords, fluid hoses may become damaged or entangled if not controlled. Thus, in one example the power supply cords, data cords, fluid hoses (e.g., discharge hose) may be routed along and may be attached to the bilge pump support 20. Each of the power supply 30 and discharge hose 32 may be provided with sufficient slack or a quick disconnect to allow easy movement and removal of the pump 26 from the bilge 24 without disconnecting the discharge hose 32 at either end.

Figure 1:
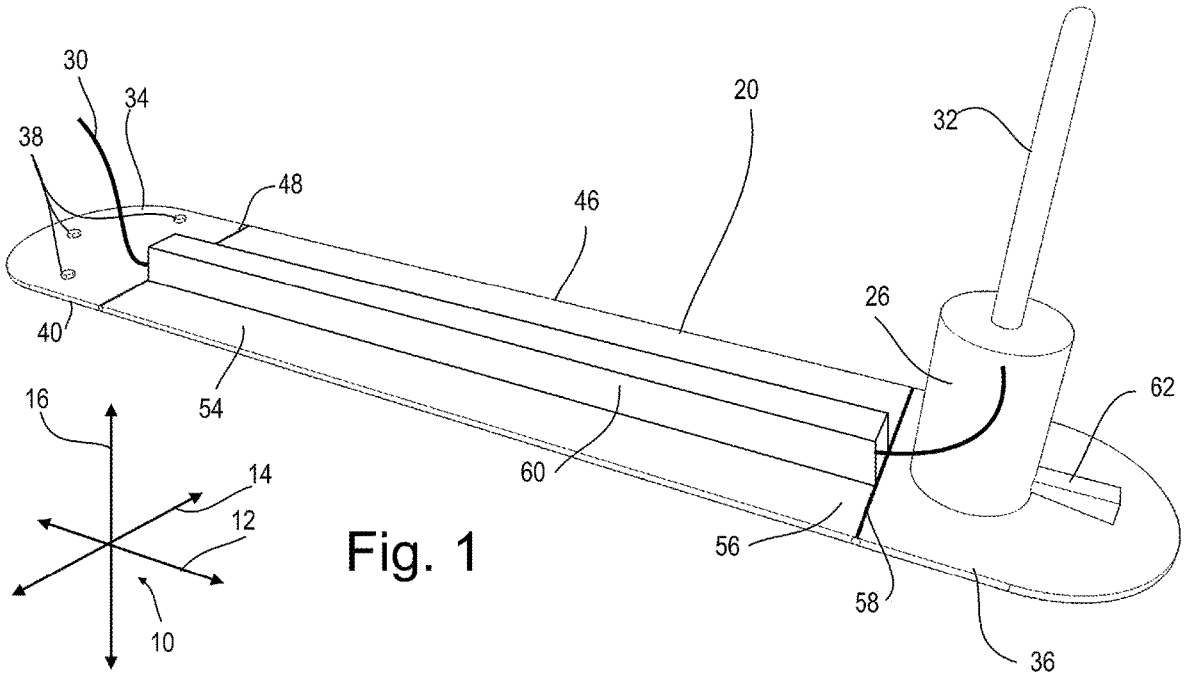
FIG. 1 is an isometric view of one example of the disclosed bilge pump support.

To aid in description, before continuing this description, an axes system 10 is provided as shown in FIG. 1. These axes including a longitudinal axis 12 aligned from a mounting plate 34 towards a pump plate 36 when the bilge pump support 20 is arranged substantially in a horizontal plane as shown in FIG. 1. The axes system 10 also including a lateral axis 14 orthogonal to the longitudinal axis in a horizontal plane. Also shown is a vertical axis 16 orthogonal to the lateral 14 and longitudinal 12 axes. In use, the bilge pump support 20 repositions (hinges) in a vertical plane defined by the longitudinal axis 12 and the vertical axis 16.

To understand the arrangement, design, and operation of the bilge pump support 20 it is shown in an operational arrangement in FIG. 5. This view is a side isometric view of the bilge pump support, with a pump 26 attached thereto as described above. The bilge pump support 20 with bilge pump 26 attached thereto is positioned within the bilge 24 and attached to the vessel 22. In this Fig. the sidewall of the holding space 24 nearest the viewer is shown transparent to show the components which would otherwise be hidden.

In use, once the pump 26 is attached to the bilge pump support 20 which is attached to the vessel 22, the discharge hose 32 is fluidly connected to transfer fluid (e.g., water) out of the bilge 24, often through the hull of the vessel to the exterior environment. A power supply 30 is also connected to a source of power such as a battery, generator, power cell, solar cell, wind vane, mechanical power drive, pneumatic or hydraulic feed pumps, etc. to operate the pump 26. Once the pump 26 is operating, it will pump water etc. through the discharge hose 32 out of the holding space 24. An operating switch such as a float switch, fluid detecting switch, resistance switch may also be mounted to the bilge pump support 20 for automatic operation as water etc. fills the holding space 24.

Looking to FIG. 1, the bilge pump support 20 comprises the mounting plate 34 which is configured to be attached to the vessel 22 by way of fasteners 38, adhesives 40, ties, or other structures and combinations thereof. In the example shown in FIG. 5 the mounting plate 42 is attached to a floor or horizontal surface 40 of the vessel 22 for ease in attachment, but it may also be mounted to the inner bulkhead 42, or inner side wall 44 of the bilge 24 or other structures of the vessel.

To ensure that the pump plate 36 can be properly positioned in the bilge, an extension plate 46 may be provided between the pump plate 36 and the mounting plate 34. The extension plate 46 attached by way of a first pivot 48, such as a hinge, to the mounting plate 34 to facilitate easy insertion and proper placement of the pump plate 36 in the holding space 24. In one example the first pivot has little appreciable friction, thus allowing free movement of the extension plate 46 and attached components relative to the mounting plate 34. In other examples, the friction of the first pivot 48 may be substantial or even adjustable to facilitate "locking" the rotation of the extension plate 46 relative to the mounting plate 34. Thus, the relative position of the extension plate 46 relative to the mounting plate 34 can be fixed.

In one example, as shown in FIG. 1 the extension plate 46 extends longitudinally 12 in a first direction and may be rotated about the first pivot 48 in a vertical plane so as to allow longitudinal/vertical installation in a bilge 24. In other words, the arrangement places the pump 26 longitudinally offset a significant distance from the mounting plate 42 such that the pump plate 36 and attached pump(s) may not be positioned directly below the mounting plate 34. This configuration allows for many installations, including installations of rather heavy pumps (over 10 lbs.) which was not possible or was not efficient with prior known installation systems.

In one example, the first pivot 48 comprises a living hinge, fold line, bending, half-barrel hinge, or other hinge/pivot. The first pivot 48 may be configured with a removable pin 50 for easy removal of the mounting plate 34 from the extension plate 46. In such an example, the pin 50 may be removed laterally 14 from a series of receiving surfaces 52 as known in removable pin hinges, such as those found in residential door hinges. Once the pin 50 is removed, the extension plate 46 and attached components may be removed from the mounting plate 34 at the first end 54 of the extension plate 46, and thus the pump 26 easily removed from the bilge 24 for cleaning, maintenance, or replacement.

In one example the pump plate 36 may be attached to a second end 56 of the extension plate 46. This attachment may be made by way of a second pivot 58, weld, or unitary construct. In one example, the second pivot 58 also comprises a living hinge, fold line, bending, half-barrel hinge, or a hinge with a removable pin. In such an example, the pin may be removed laterally 14 from a series of receiving surfaces. Once the pin 50 is removed, the pump plate 36 and attached components may be removed from the extension plate 46, and thus the pump 26 and attached pump plate 36 removed from the bilge 24 for cleaning, maintenance, or replacement.

In one example, one or both of the first pivot 48 and/or second pivot 58 may be substantially unhindered in their frictional connection between the components. While this will allow the pump plate 36 and attached pump 26 to move freely as the vessel moves, the arrangement of the components, the configuration of the holding space 24, and the mass (weight) of the pump plate 36 and pump 26 keeps the pump 26 in a desired placement and position for optimum operation. In one example, the pump may be less dense than the fluid (e.g., water) in the bilge, and thus the density/mass of the pump plate 36, an added weight plate, or other structures may be included to offset the positive buoyancy of the pump and attached components such as the float switch.

In other examples, the first pivot 48 and/or second pivot 58 may be tensioned by way of adjustable fasteners or other structures to hinder and control or completely restrict movement of the extension plate 46 relative to the mounting plate 34 and/or pump plate 36.

In some applications, it may be desired to control the position of the power supply cord 30 for safety and efficiency. For example, where it is desired that the power supply 30 not come in contact with hard or sharp edges which may deteriorate the power supply cord 30 including an electrical insulating layer(s) thereof and cause a short which may cause the pump 26 to cease to function or may cause a fire or electrical problems elsewhere on the vessel 22. For these purposes, in one example a wiring conduit 60 may be provided along the bilge pump support 20. In the example shown in FIG. 1, the wiring conduit 60 is affixed to and protrudes from the extension plate 46 to protect the power supply 30 there within from impact and abrasion damage. In other examples the wiring conduit 60 may comprise eyelets, rings, zip ties, wire ties, or other structures configured to maintain the power supply cord 30 away from hazardous structures.

Figure 2:
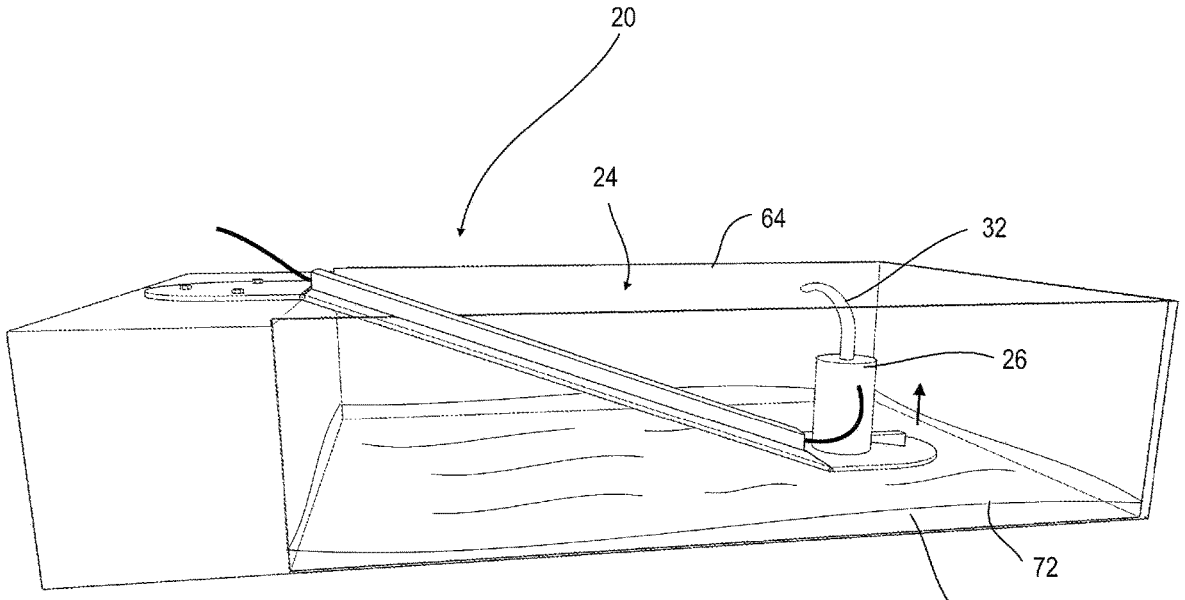
FIG. 2 shows the bilge pump support of FIG. 1 inserted into a bilge of a vessel.
Figure 3:
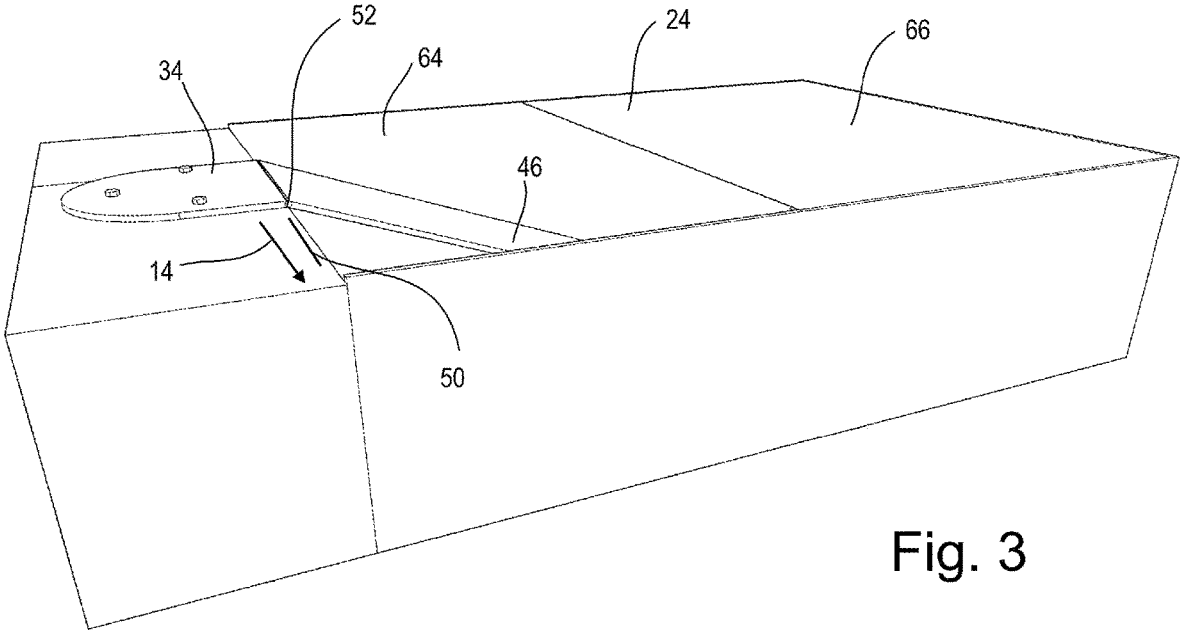
FIG. 3 is another view of the bilge pump support of FIG. 1 inserted into a bilge of a vessel, bilge having a cover over part of the bilge.
Figure 4:
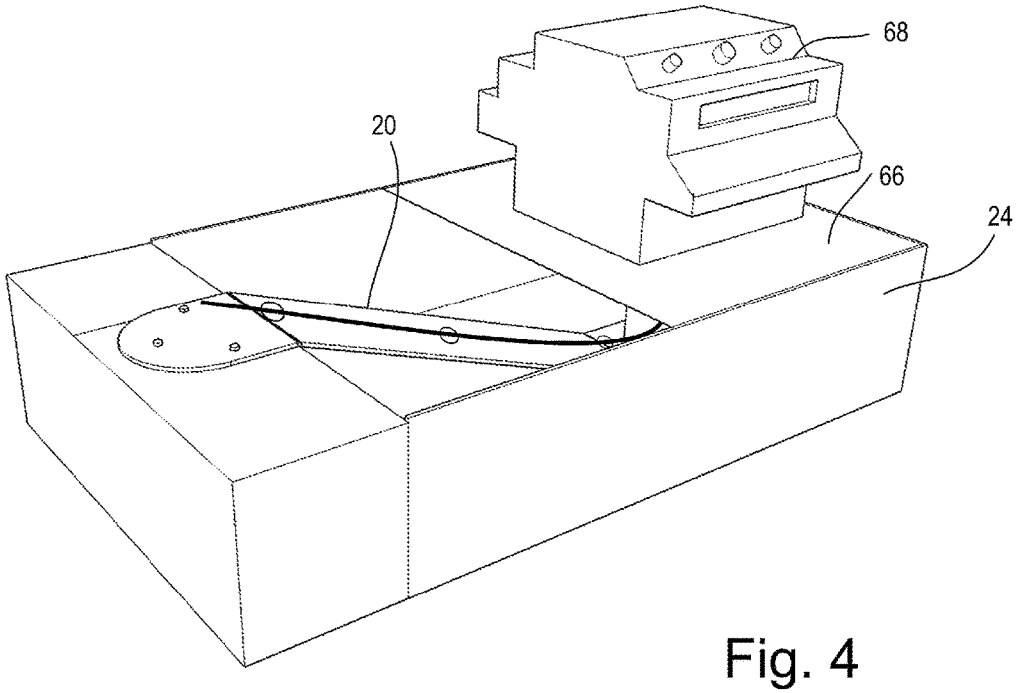
FIG. 4 is another view of the bilge pump support of FIG. 1 inserted into a bilge of a vessel, the bilge having a cover part optionally with machinery positioned thereupon.

One substantial advantage of one example of the disclosed bilge pump support 20 is that the arrangement allows one or more pumps 26, float switch(s) 62 and other components to be placed within holding spaces 24 in positions that may otherwise not be accessible. For example, as shown in the example of FIG. 2 the holding space comprises an upper edge 64 and a bilge cover 66 which partially hinders access to the portion of the holding space 24 where it is desired to place the pump 26. This may be to position the pump 26 beneath machinery 68 such as an engine, generator, etc. In other examples this is to place the pump 26 in the deepest part of the holding space 24 to maximize fluid removal or efficiency. Fluid 70 such as oil, contaminates, water with an upper or fluid level 72 is periodically present in the bilge, and it is the function of the pump 26 to remove this fluid 70 or at least a significant portion thereof. Thus, proper positioning of the pump 26 is greatly desired.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A bilge pump support comprising:

a mounting plate configured to be attached to a vessel;

the mounting plate having a first pivot on a first longitudinal end thereof, an extension plate having a first end connected to the first pivot and extending longitudinally therefrom in a first longitudinal direction;

a second pivot on a second longitudinal end of the extension plate longitudinally opposing the first longitudinal end;

a pump plate connected to the second pivot and extending longitudinally therefrom and extending longitudinally from the extension plate in a second longitudinal direction longitudinally opposing the first longitudinal direction;

the pump plate configured to have a bilge pump attached thereto within a holding space of the vessel; and wherein the pump plate is longitudinally and vertically offset from the mounting plate.

2. The bilge pump support as recited in claim 1 the pump plate having a negative buoyancy greater than a buoyancy of the bilge pump.

3. The bilge pump support as recited in claim 1 the pump plate having a density greater than 1 gram per cubic centimeter (1 g/cm3).

4. The bilge pump support as recited in claim 3 the pump plate and bilge pump combined having a density greater than 1 gram per cubic centimeter (1 g/cm3).

5. The bilge pump support as recited in claim 1; the first pivot being unhindered.

6. The bilge pump support as recited in claim 5; the second pivot being unhindered.

7. The bilge pump support as recited in claim 1; the second pivot being unhindered.

8. The bilge pump support as recited in claim 1; the first pivot having a removable pivot pin configured to release the extension plate from the mounting plate for ease in removal of the bilge pump from the bilge.

9. The bilge pump support as recited in claim 1; the extension plate comprising a wiring conduit.

10. The bilge pump support as recited in claim 1; the pump plate connected to the second pivot and extending longitudinally therefrom and extending longitudinally therefrom in the first longitudinal direction.

11. A bilge pump support comprising:

a mounting plate configured to be attached to a vessel;

the mounting plate having a first pivot on a first longitudinal end thereof, an extension plate having a first end connected to the first pivot and extending longitudinally therefrom in a first longitudinal direction;

a second pivot on a second longitudinal end of the extension plate longitudinally opposing the first longitudinal end;

a pump plate connected to the second pivot and extending longitudinally therefrom and extending longitudinally therefrom;

the pump plate configured to have a bilge pump attached thereto within a holding space of the vessel;

wherein the pump plate is longitudinally and vertically offset from the mounting plate; and the extension plate comprising a wiring conduit.

12. A bilge pump support comprising:

a mounting plate configured to be attached to a vessel;

the mounting plate having a first pivot on a first longitudinal end thereof, an extension plate having a first end connected to the first pivot and extending longitudinally therefrom in a first longitudinal direction;

a second pivot on a second longitudinal end of the extension plate longitudinally opposing the first longitudinal end;

a pump plate connected to the second pivot and extending longitudinally therefrom and extending longitudinally therefrom;

the pump plate configured to have a bilge pump attached thereto within a holding space of the vessel; and the pump plate having a negative buoyancy with a density greater than a density of the bilge pump.

13. The bilge pump support as recited in claim 12 the pump plate and bilge pump combined having a density greater than 1 gram per cubic centimeter (1 g/cm3).

14. The bilge pump support as recited in claim 12; the first pivot being unhindered.

15. The bilge pump support as recited in claim 14; the second pivot being unhindered.

16. The bilge pump support as recited in claim 13; the first pivot having a removable pivot pin configured to release the extension plate from the mounting plate for ease in removal of the bilge pump from the bilge.

17. The bilge pump support as recited in claim 13; the extension plate comprising a wiring conduit.

18. The bilge pump support as recited in claim 13; the pump plate connected to the second pivot and extending longitudinally therefrom and extending longitudinally therefrom in the first longitudinal direction.

* * * * *